United States Patent [19]

Trottier

[11] Patent Number: 4,942,893

[45] Date of Patent: Jul. 24, 1990

[54] HAIR HIGHLIGHTING CAPSULE

[76] Inventor: Allan J. Trottier, 1121 Woodvale Dr., Gallatin, Tenn. 37066

[21] Appl. No.: 227,555

[22] Filed: Aug. 3, 1988

[51] Int. Cl.[5] ..... A45D 19/18

[52] U.S. Cl. ..... 132/270; 132/208

[58] Field of Search ..... 132/207, 221, 222, 270, 132/202, 203, 208

[56] References Cited

U.S. PATENT DOCUMENTS

| | | | |
|---|---|---|---|
| 3,103,933 | 9/1963 | Sanzo | 132/270 |
| 3,692,032 | 9/1972 | Regas | 132/212 |
| 3,726,289 | 4/1973 | Thompson | 132/221 |
| 3,800,811 | 4/1974 | Esposto | 132/270 |
| 3,805,810 | 4/1974 | Savala | 132/270 |
| 3,941,613 | 2/1976 | Nicoletti | 132/270 |
| 4,144,897 | 3/1979 | Mosz | 132/270 |
| 4,398,549 | 8/1983 | Thomas | 132/270 |
| 4,503,870 | 3/1985 | Peterson | 132/270 |

*Primary Examiner*—John J. Wilson
*Assistant Examiner*—Michael Lynch
*Attorney, Agent, or Firm*—Janine J. Weins; Michael J. Weins

[57] ABSTRACT

The present invention is directed to a hair highlighting capsule which confines the hair and the coloring solution for a time sufficient to effect the desired coloration of the hair. The hair highlighting capsule is preferably transparent so that the stylist can observe the process. The capsule of the present invention is reusable and easily sealable. The hair highlighting capsule has a female side which is provided with a central cavity and a male side which is provided with a projection. The projection is contoured to be accepted by the central cavity. The depth of the cavity and mating projection are preferably about 0.125 inches. A hinge connects the female side and the male side and is positioned so that the projection and central cavity will register when the capsule is closed. The capsule is sealed by locking the projection into the central cavity. The seal limits flow of the chemical coloring solution from the capsule and excludes the flow of water and other fluids into the capsule. To aid in the opening the capsule, tabs which extend from the periphery of the capsule are preferably provided and positioned so that when the male side and female side are engaged the tabs are non-coincident. To assure the capsule has sufficient rigidity both the central cavity and the projection are surrounded by lips. In a preferred embodiment transverse ridges and mating grooves are provided to the capsule to add rigidity and limit slippage of the hair that is confined within the capsule.

10 Claims, 2 Drawing Sheets

HAIR HIGHLIGHTING CAPSULE

FIELD OF INVENTION

The present invention is directed to a device for use in bleaching and/or dyeing hair, and to the method of using the device.

BACKGROUND ART

A number of people change the color of their hair to be stylish, or to change their images. As long as some believe "blondes have more fun!" or "if you have grey hair you look too old to hire" there will be a demand for hair coloring.

Since hair which has varying shades of color is more stylish and may look more natural than hair that is dyed to a single color many individuals prefer to highlight and streak their hair rather than to dye or bleach their entire head of hair. The process of highlighting and streaking hair by the selective application of bleach or dye is effected by placing a chemical bleaching or dyeing solution in contact with selected portions of the hair for a time sufficient to achieve the desired coloration.

A number of methods and a variety of equipment has been developed for the selective coloring and/or bleaching of the hair. Among the most common of these techniques is a process called foiling. Foiling requires that a chemical bleach or dye solution be placed on selected strands of hair and the hair then be wrapped in aluminum foil for a time sufficient to effect the desired coloration of the hair. Because the foil is opaque the stylist cannot view the hair while the hair is being treated with the chemical solution. The foiling technique has the additional disadvantages in that it is difficult to seal the chemical solution within the foil and thus some of the chemical solution may leak onto the scalp causing irritation and red spots. The chemical solution may also leak onto adjacent strands of hair causing an unattractive appearance. Using the foiling technique it is difficult to color the hair close to the scalp and the highlighting or streaking may look unattractive and after a short period of time it may be necessary to retreat the hair. Additionally, the foiling process is messy and forming the foil wrap requires skill and time.

Another method of streaking or highlighting hair is to use a rubber cap which fits tightly over the head. The hair that is to be highlighted or streaked is pulled through openings which are provided to the cap by use of a hook type device. The hair that protrudes from the cap is treated with a chemical solution to effect the desired bleaching or dyeing. The cap is uncomfortable to wear and because the hair is pulled through the cap it is not always possible to know exactly which portion of the hair is being colored, and in addition it is difficult to color the hair close to the scalp.

In an effort to overcome the disadvantages of using foiling or a cap some transparent plastic pouches have been developed. These plastic pouches replace the foil and have the advantage that they allow the hair to be viewed during the treatment process. The prior art plastic pouches do not tend to seal well and therefore the chemical solution may leak. Most of these devices utilize an auxiliary sealing means such as a clip and are frequently difficult to seal and the process of sealing is time consuming. Many of the transparent plastic devices are disposable and are therefore more expensive than foil.

There is a need for a hair coloring device which can be readily manufactured, is simple to use and allows for selective and reproducible hair coloring. Such a device should preferably be transparent so that stylists can view the hair during the coloring process.

There is a need for a device which will allow hair to be colored close to the scalp without leakage of chemical solutions onto either the scalp or adjacent hair.

Additionally there would be a cost savings and inventory control would be more easily maintained if the device for use in coloring the hair could be reused.

A device that would be relatively light in weight and thus would not be burdensome to the client and would not tend to slip from the hair would be desirable.

Further a device that could accommodate long hair would have utility since many people who desire to have their hair highlighted or streaked have long hair.

The present invention overcomes many of the drawbacks associated with prior art devices and satisfies many of the currently unanswered requirements for a hair coloring device.

SUMMARY OF INVENTION

It is an object of the present invention to provide a hair highlighting capsule which can be quickly and easily applied and thus reduce the time and labor required to streak and/or highlight hair.

It is an object of the present invention to provide a hair highlighting capsule that can be sealed with a minimum of dexterity and with a high degree of reliability.

It is an object of the present invention to provide a transparent hair highlighting capsule so that the coloring, bleaching and highlighting process can be observed.

It is an object of the present invention to provide a capsule which will allow long hair to be readily highlighted.

It is an object of the present invention to provide a hair highlighting capsule which will allow alternating strands of hair to be bleached or dyed.

It is an object of the present invention to allow portions of the hair to be colored at the same time other portions of the hair are being treated with a permanent.

It is an object of the present invention to provide a hair highlighting capsule which will allow portions of the hair to be washed or rinsed at the same time that other portions of the hair are confined within the highlighting capsule with the desired bleaching or dyeing solution.

It is an object of the present invention to provide a hair highlighting capsule which is light in weight.

It is an object of the present invention to provide a hair highlighting capsule comfortable to wear.

It is an object of the present invention to provide a hair highlighting capsule which will not allow solution confined within the capsule to leak out of the capsule and which will allow hair not confined within the capsule to be rinsed without the risk of the rinsing solution seeping into the capsule.

It is an object of the present invention to provide a hair highlighting capsule which can withstand the heat of a drier so that the hair and the confining capsule can be placed under a drier and thereby the chemical coloring process can be accelerated.

It is an object of the present invention to provide a hair highlighting capsule which can be reused.

It is an object of the present invention to provide a hair highlighting capsule that is attractive.

It is an object of the present invention to provide a hair highlighting capsule which allows for the coloring of only a portion of the length of a strand of hair.

It is an object of the present invention to provide a transparent hair highlighting capsule that will allow the stylist to monitor the progress of the hair highlighting operation.

It is an object of the present invention to provide a hair highlighting capsule which significantly reduces the leakage and therefore reduces red spots on the scalp.

It is an object of the present invention to provide a capsule which allows hair highlighting to be done close to the scalp thereby extending the time between treatments.

It is an object of the present invention to produce a hair highlighting device from a single sheet of transparent material.

These and other objects of the present invention will become apparent from the following description, drawings and claims.

The present invention is directed to a transparent capsule which is used for confining hair in contact with a chemical treating solution for a time sufficient to effect the desired highlighting.

The hair highlighting capsule of the present invention is reusable, easily sealable, capsule which encloses the hair and the chemical dyeing or bleaching solution for a time sufficient to allow the hair to be chemically treated to the extent desired.

The hair highlighting capsule is preferably transparent so that the stylist can observe the process and can determine when the treatment should be terminated.

The hair highlighting capsule of the present invention is comprised of a female side and a male side which are connected by a hinge. The female side is embossed with a central cavity, while the male side has an embossed projection. The projection in the male side is contoured to be accepted by the central cavity which is provided to the female side. The depth of the cavity and mating projection are preferably about 0.125 inches. The hinge is positioned so as to assure that the male side projection and the female side central cavity will register when the hair highlighting capsule is closed.

Means are provided for locking the male side projection into the female side central cavity to an extent sufficient to limit flow of the chemical treating solution from the capsule, and to exclude flow of water and other rinsing and treating solutions into the capsule.

To aid in the opening of the hair highlighting capsule, tabs which extend from the periphery of the capsule are preferably provided. The tabs are positioned such that when the capsule is closed the tabs are non-coincident.

To assure that the capsule has sufficient rigidity both the central cavity and the protrusion are surrounded by lips. The lips provide support, assist in providing a secure closure, and aid in sealing fluid within the cavity. It is preferred that the lips be approximately 0.25 inches.

The means for locking and sealing the capsule are preferably protrusions provided to the side wall of the male projection which interlock with indentations provided to the side wall of the female cavity.

The device of the present invention can be formed from a single sheet of transparent plastic material by a drawing or stamping operation.

In a preferred embodiment of the present invention transverse ridges are provided to the cavity and to the projection. The transverse ridges assist the capsule in gripping the hair.

The hinge can be formed by a single V groove or from multiple V grooves. A double V groove which forms a "W" hinge is preferred since a hinge of this design will distribute the bending forces.

BEST MODE OF CARRYING THE INVENTION INTO PRACTICE

Figure 1:
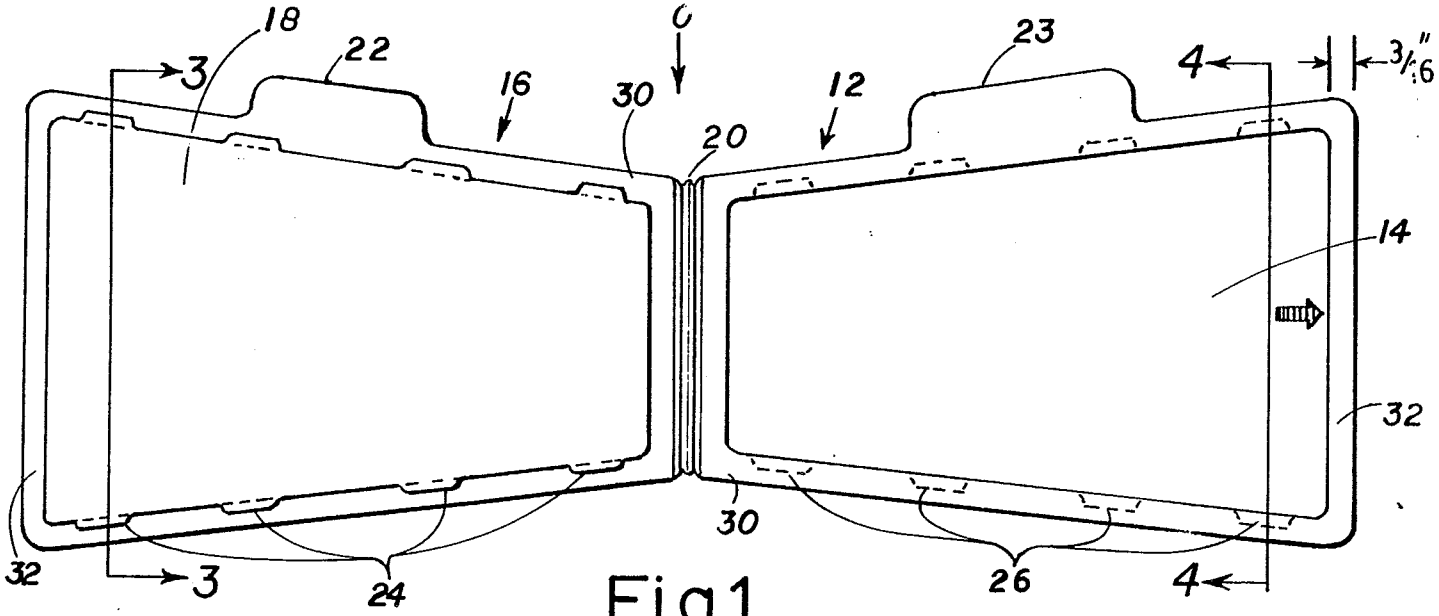
FIG. 1 is a top view of the hair highlighting capsule of the present invention in the open position.

FIG. 1 is a top plan view of a hair highlighting capsule 10 in accordance with one embodiment of the present invention. The female side 12 has a central cavity 14. The male side 16 has a central projection 18. The central projection 18 is contoured to mate with the central cavity 14. The shape of the cavity and the protrusion is preferentially trapezoidal with the sides diverging at a rate of about 1 inch in 6 inches. Preferably the depth of the cavity is about 0.125 inches. This depth has been found sufficient to hold the hair in contact with a sufficient quantity of solution.

A hinge 20 joins the male side 16 and the female side 12. The hinge 20 is positioned so that the central cavity 14 will register with the projection 18 when the capsule is closed.

Figure 2:
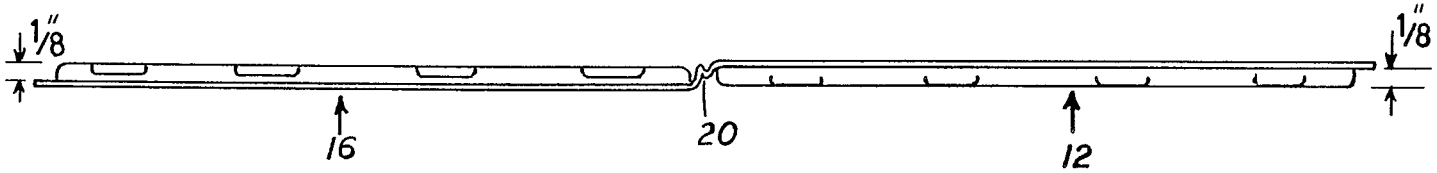
FIG. 2 is a side view of the hair highlighting capsule of the present invention in the open position.

FIG. 2 is a side view of the capsule. The hinge 20 has a "W" profile. The "W" hinge contour is preferred since such a profile gives flexibility and relatively long hinge life. Alternatively a hinge having a "V" contour or a flexible connection member could be used to connect the female side 12 and the male side 16. To aid in the opening of the hair highlighting capsule, tabs 22 and 23 which extend from the periphery of the capsule are preferably provided. The tabs 22 and 23 are positioned such that when the capsule is closed the tabs 22 and 23 are non-coincident.

The male side 16, the hinge 20 and the female side 12 can be made from a single sheet of material. The material must be resistant to chemical attack by the bleaching and dyeing solutions that may be used and preferably the material is a clear transparent material such as PVC. PVC is resistant to most hair treatment solutions, is pliable and is strong. A hair highlighting capsule in accordance with the present invention can be made from a PVC sheet having a thickness of about 0.012 inches.

Figure 3:
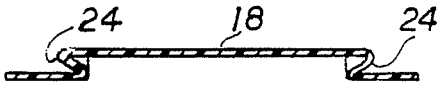
FIG. 3 is a sectional view of the male side of the hair highlighting capsule of the present invention along line 3—3 as shown in FIG. 1.
Figure 4:
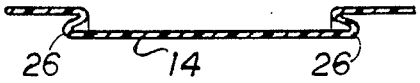
FIG. 4 is a sectional view of the female side of the hair highlighting capsule of the present invention along line 4—4 as shown in FIG. 1.

Locking means are provided to interlock the male projection with the female cavity. FIG. 3 shows a cross section of the male side 16 along line 3—3. FIG. 4 shows a cross section of the female side 12 along line 4—4. FIGS. 3 and 4 show the contour of the sidewall of the projection 18 and the cavity 14 respectively.

Side lips 28, a hinge lip 30 and an end lip 32 are provided to the capsule 10. The lips 28, 30 and 32 contribute to the rigidity of the capsule. A nominal width of 0.25 inches is recommended for the side lips 28. The end lip 32 should be 0.1875 inches or to assure hair in close proximity to the scalp is brought into the pocket and is contacted by the hair coloring solution. The lip dimensions may vary depending on the capsule material and thickness of the material. For thicker or more rigid materials a smaller lip can be used while maintaining rigidity.

Figure 5:
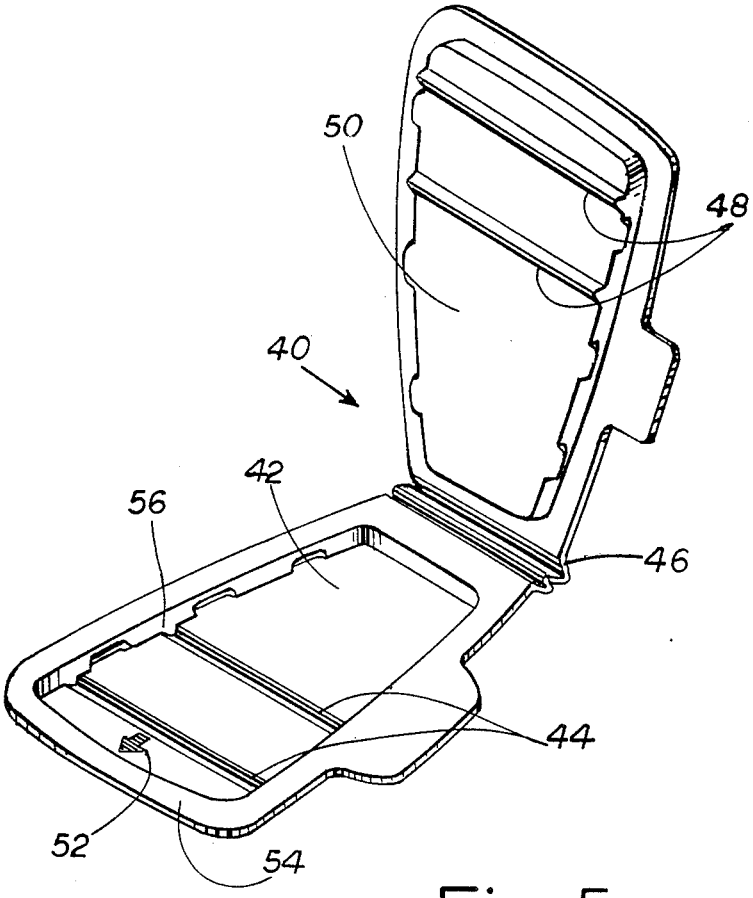
FIG. 5 is a perspective view of a preferred embodiment of the hair highlighting capsule of the present invention.

FIG. 5 shows a preferred embodiment 40 of the present invention. The central cavity 42 is provided with grooves 44 which are parallel to the hinge 46. Ridges 48 are provided on the projection 50. The ridges 48 engage the grooves 44 when the capsule is closed. The grooves 44 and intermeshing ridges 48 provide resistance to slippage of the hair and enhances the rigidity of the capsule.

The sidewall 56 of the cavity 42 should preferably have a depth of about 0.125 inches.

Preferably a directional arrow imprint 52 is embossed in the cavity 42 on the capsule to indicate the edge 54 of the capsule that should be placed in close proximity to the crown of the head.

The hair highlighting capsule of the present invention can be used to perm and highlight hair at the same time. The hair is first permed in a zig-zag form and then strands of hair are put into the capsule and painted from the roots up with a dye or bleach solution. This procedure gives the client a soft perm with highlighted areas.

While the present invention has been described in view of preferred embodiments and particular application it should be appreciated by those skilled in the art that embodiments of other geometry not specifically mentioned could be made by those skilled in the art without departing from the spirit of the invention.

What I claim is:

1. A hair highlighting capsule comprising:

a female side formed of a sheet of material, said sheet of material being embossed with a central cavity bounded by a cavity sidewall, said central cavity and cavity sidewall being bounded on three sides by two side lips and an end lip;

a male side formed of a sheet of material, said sheet of material being embossed with a projection bounded by a projection sidewall, said projection and projection sidewall being bounded on three sides by two side lips and an end lip, said projection of said male side being so configured to mate with said central cavity of said female side;

a hinge joining said male side and said female side, said hinge positioned such that said projection and said central cavity will register when said capsule is closed; and means being provided to the male side and to the female side for locking said projection into said cavity.

2. The capsule of claim 1 further comprising:

a first tab attached to said female side; and a second tab attached to said male side said second tab being so positioned that said first tab and said second tab are non-coincident when said capsule is closed.

3. The capsule of claim 1 wherein said side lips are about 0.25 inches and said end lip is less than or equal to 0.1875 inches.

4. The capsule of claim 1 wherein said means for locking comprises male protrusions on said projection sidewall which engage female slots in said cavity sidewall.

5. The capsule of claim 4 wherein said hinge is a W hinge.

6. The capsule of claim 4 wherein said projection and said central cavity have height and depth respectively of about 0.125 inch.

7. The capsule of claim 1 wherein grooves are provided to said central cavity and ridges are provided to said projection to engage said grooves when said capsule is closed.

8. The capsule of claim 1 wherein said female side, said hinge and said male side are formed from a sheet of clear transparent material.

9. The capsule of claim 8 wherein said clear transparent material is a sheet of PVC approximately 0.12 mil. thick.

10. The capsule of claim 8 wherein said central cavity is trapezoidal with the non-parallel sides diverging at about 1 inch in 6 inches of length.

* * * * *